US006107010A

United States Patent [19]

Corniglion et al.

[11] Patent Number: 6,107,010

[45] Date of Patent: Aug. 22, 2000

[54] METHOD FOR PRINTING ON A PORTABLE DATA MEDIUM, PARTICULARLY A SMART CARD, AND RESULTING PRINTED DATA MEDIUM

[75] Inventors: Isabelle Corniglion, Auriol; Armand Gellis; Robert Guguelmetti, both of Marseilles; Christian Leriche, Trets; Paul Morgavi, La Ciotat; Andre Samat, Marseilles, all of France

[73] Assignee: Gemplus S.C.A., Gemenos, France

[21] Appl. No.: 09/202,425

[22] PCT Filed: Jun. 11, 1997

[86] PCT No.: PCT/FR97/01044

§ 371 Date: Feb. 25, 1999

§ 102(e) Date: Feb. 25, 1999

[87] PCT Pub. No.: WO97/48016

PCT Pub. Date: Dec. 18, 1997

[30] Foreign Application Priority Data

Jun. 11, 1996 [FR] France ..... 96 07240

[51] Int. Cl.[7] ..... G03C 5/56; B41M 3/14; B41M 5/28

[52] U.S. Cl. ..... 430/333; 430/292; 430/337; 430/338; 430/945; 430/962; 235/488

[58] Field of Search ..... 235/488, 493, 235/492; 430/945, 962, 292, 332, 333, 337, 338, 345, 346

[56] References Cited

U.S. PATENT DOCUMENTS

| | | | |
|---|---|---|---|
| 3,615,454 | 10/1971 | Cescomi . | |
| 5,330,686 | 7/1994 | Smith et al. | 252/586 |

FOREIGN PATENT DOCUMENTS

| | | |
|---|---|---|
| 0279600 | 8/1988 | European Pat. Off. . |
| 0327788 | 8/1989 | European Pat. Off. . |
| 0530699 | 3/1993 | European Pat. Off. . |
| 3-066024 | 3/1991 | Japan . |
| 5-333462 | 12/1993 | Japan . |

*Primary Examiner*—John McPherson
*Attorney, Agent, or Firm*—Roland Plottel

[57] ABSTRACT

A method for printing on an exposed polymerised thermoplastic or curable layer of the body of a portable data medium, and a portable data medium particularly a chip card, comprising a polymerised layer, are disclosed. The method comprises the steps of mixing a polymerisable thermoplastic or curable binder and at least one light-sensitive compound responsive to laser radiation having a predetermined wavelength in such a way that it changes from a first state to a second coloured state, in order to form a mixture, exposing the mixture to the laser radiation having a predetermined wavelength; and polymerising the mixture to form the polymerised layer of the body of the data medium. The method is particularly suitable for printing on smart cards.

15 Claims, No Drawings

METHOD FOR PRINTING ON A PORTABLE DATA MEDIUM, PARTICULARLY A SMART CARD, AND RESULTING PRINTED DATA MEDIUM

The invention relates to the area of printing and deals in particular with printing a visible thermoplastic or thermosetting polymerized layer of a portable data medium.

The term "printing" in the present invention must be considered in the broad sense as being a technique in which an action is applied to an object in such a way as to leave a visible mark on this object. The portable data medium can be any data medium. However, it is in particular a standard data medium in the smart card format to which reference will be made in the description hereinbelow.

Smart cards and, in general, memory cards have a thermoplastic or thermosetting card body formed of one or more layers. Two faces of this body are visible. These faces show a drawing, a logo, a photographic reproduction, and often written information printed serially according to various known methods.

Certain printing methods involve simply classical ink deposition. Other methods, which are generally more rapid and precise, involve lasers.

The latter known methods include methods in which a colored ink is heat-transferred by a laser from a heat-resistant transfer film applied to one face of the polymerized card body. With different films or different segments of one and the same film having inks of different colors, a card body is obtained that exhibits a color design according to the path of the laser radiation on the film or films. However, such methods, known as indirect methods, require the intermediary of a film from which the inks diffuse and are accordingly slow. Moreover, since the laser radiation diameter applied to the film or films must be sufficient for the inks to be transferred to the surface and/or into the body of the card and, moreover, the colored inks that were not initially present in the card body are likely to diffuse in this body, the definition of the design obtained is poor.

In other known methods, using a YAG laser adjusted to emit infrared electromagnetic radiation, a given zone of a top layer of a multilayer card body is removed to reveal a sublayer of the body whose color is different from that of the top layer. With several superimposed layers of different colors, it is possible to obtain a multicolored card body whose design is defined by directed scanning of the laser radiation. However, ablation of all the layers or sublayers covering a sublayer to obtain a given color of a given area of this sublayer in theory requires several laser passes, which prolongs the time taken by the methods. Moreover, product is wasted and the surface of the printed card body does not stay intact because it has differences in relief. Hence it is not always possible to apply a perfectly flat, transparent, protective film to the card body.

Still other methods propose either evaporation of particular areas of the card body surface, or foaming these areas. This evaporation or foaming is induced by the heat produced by laser radiation. Evaporation leaves a hole and can reveal a colored sublayer of the card body. Foaming changes the nature of the card body surface which for example exhibits differences in refractive index which generate the designs. In general these methods are slow, and both definition and contrast of the design are poor. In addition, as before, the surface of the card body does not remain intact.

Finally, so-called bleaching methods propose directed, selective destruction of pigments or other color molecules contained in a layer of the card body by a laser whose radiation is emitted in the visible range. The color appears negatively. Thus, to cause a given color to appear, two laser irradiations are necessary. For example, to cause blue to appear at the surface of a black layer of a card body that contains blue, red, and yellow pigments, two laser radiations are necessary, one destroying the red pigments, and the other, the yellow pigments. If white is to be obtained, the black layer of the card body is irradiated with three laser radiations of different wavelengths. These methods are slow because obtaining one color at a given spot requires several irradiations. Moreover, the white obtained is imperfect because destruction of colored pigments or molecules is never total and, in practice, the colors obtained are pale.

In view of the aforementioned prior art, one goal of the invention is a novel method for serial printing of a visible thermoplastic or thermosetting polymerized layer of a portable data medium body which is rapid and leaves the surface of this layer intact.

The claimed solution of the invention relates to a method for printing a visible thermoplastic or thermosetting polymerized layer of a portable data medium, characterized by including the following steps:

mixing a thermoplastic or thermosetting polymerizable binder, at least one photochromic compound sensitive to a laser radiation of a given wavelength in order to pass from a first state to a second colored state, and in order to form a mixture;

irradiating the mixture by laser radiation of a given wavelength;

fixing the second colored state; and polymerizing the mixture in order to form the polymerized layer of the data medium body.

Thus, to obtain a different color, one proceeds positively: the appropriate photochromic compound is irradiated with a unique laser radiation of a given wavelength.

Moreover, the invention relates to a portable data medium including a visible thermoplastic or thermosetting polymerized layer of a data medium body, characterized in that this polymerized layer includes:

a thermoplastic or thermosetting polymerized binder; and at least one photochromic compound fixed in a second colored state obtained from a first state by irradiation by a laser irradiation of given wavelength.

The description hereinbelow will give a better understanding of the way in which the invention can be reduced to practice. It is written with reference to a nonlimiting embodiment relating to a data medium in a card format of the smart card type. However, it is understood that the invention applies to any data medium whatever provided this medium has a visible thermoplastic or thermosetting polymerized layer.

Smart cards have principally a micromodule included in a card body.

The micromodule is composed of an integrated circuit chip connected to metal contacts flush with the surface of the card body and/or a antenna embedded in this body. Depending on whether the micromodule is connected to an antenna or to contacts, the smart card is known as a contactless or contact-type card. Where the card has both operating modalities, it is known as a hybrid card.

The card body is a thin, rectangular parallelepiped whose dimensions, as defined by Standard 7810, are approximately 85 mm long by 54 mm wide by 0.76 mm thick. Hence the card body has six surfaces of which the two major surfaces are parallel and plane. It is composed of one or more superimposed layers, with one layer of the body being visible at each of the major surfaces. These visible layers are printed and exhibit a design which may or may not be in color. They may be covered with a transparent, protective film.

The various layers of the card body and, in particular, the visible layers of the body are thermoplastic or thermohardening or photocuring polymerized layers. Hence they include a polymer from one or more monomers. The polymers are for example: acryonitrile-butadiene-styrene (ABS), polycarbonate (PC), polyethylene terephthalate (PET), polyvinyl chloride (PVC), and polymethyl methacrylate (PMMA), or any other polymer derivative of the acrylic or methacrylic group.

The card body layer or layers are white or whitish. This color can be improved by adding an inorganic additive, for example calcium carbonate or titanium dioxide, to the composition of the card body. Note that the white color is not limitative and that certain card bodies are colored or even transparent before printing in the case of a card body made of PMMA.

The printing method of the invention has several steps.

A first step relates to mixing, in the liquid phase, at least one polymerizable binder, at least one photochromic compound, and, advantageously, at least one reagent. The mixture obtained is a more or less viscous liquid.

The polymerizable binder is a binder designed to form the polymerized structure or polymer network of the visible layer or layers of the card body and of the other layers of this body. It has one or more monomers or oligomers, one or more polymers, a reagent for polymerizing these monomers or oligomers, a reagent for polymerizing or post-polymerizing the polymers, and various other compounds or additives, for example a inorganic additive for bleaching the card, and a solvent.

Photochromic compounds are compounds able to undergo a reversible transformation brought about by electromagnetic radiation between two states having different absorption spectra. A first state is characterized by a first absorption spectrum which has at least one absorption band and a second state is characterized by a second absorption spectrum which also has at least one absorption band. In their first state, photochromic compounds are normally colorless and their absorption spectrum does not belong to the visible range, namely the range where the wavelengths are between 400 and 780 nm. However, one absorption band of this spectrum is located outside the visible range, in the ultraviolet range, namely in the range in which the wavelengths are between 20 and 400 nm. Preferably, this band is in a range of 200 to 400 nm. Thus, an electromagnetic radiation whose wavelength is within the aforesaid absorption band is able to bring about a transformation in the photochromic compound from the first state to the second state. This transformation may be unimolecular or bimolecular. The transition time from the first state to the second is very short, less than approximately 20 ns, for example 40 to 50 ps for spironaphthooxazines. In their second state, the photochromic compounds absorb part of the light they receive because, in this second state, their absorption spectrum includes bands located in the visible range. These photochromic compounds thus appear to be colored. The transformation is reversible and, since the second state is metastable, a photochromic compound in its second state can be transformed to its first, more stable, state. Depending on the way in which the photochromic compounds are transformed from the second state to the first state, these compounds are either photoreversible or thermoreversible or photothermoreversible or multiphotochromic or electrochemical.

The photochromic compounds of the invention can be simply dissolved in the solvent of the mixture or advantageously contained in microparticles or microcapsules which dissolve in this solvent, thus releasing their compounds into the mixture. They are soluble in the polymerizable binder. For this purpose, chains, hydrophilic chains for example, can advantageously be grafted onto these compounds.

In practice, the mixture of the invention has three different colorless photochromic compounds: a first, a second, and a third compound. In its second state, the first compound appears yellow or green, in its second state, the second compound appears magenta red, and in its seconds state, the third compound appears cyan blue. These compounds are chosen such that, in the mixture, the absorption band of the first compound in its first state is sufficiently distinguished from the absorption band of the second compound in its first state, these bands also being sufficiently distinguished from the absorption band of the third compound in its first state. Thus, in the mixture, it is possible selectively to irradiate one of the compounds in its absorption band to trigger its transformation without the other compounds being transformed.

Photochromic compounds that can advantageously be employed in the method of the invention are bicyclic or polycyclic spiran compounds having one carbon atom common to the two rings: the spiran atom. Of these compounds, the spirooxazines, spiropyrans, and derived compounds react, under the effect of electromagnetic radiation h, according to the following reaction:

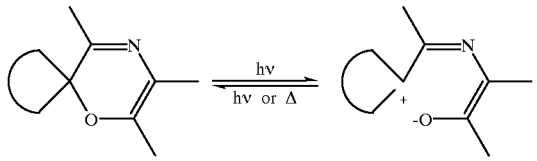

first state
non-plane form

Second state
plane form

In their first state, the rings of the spiran atom of the spirooxazines and spiropyrans are distributed in space orthogonally and appear to be colorless. However, in their second state, these rings form a plane and appear to be colored. Moreover, these compounds have the property of being mixable in a polymer medium while retaining their photochromic properties in this medium. Of course, depending on the nature, for example the polarity or viscosity, of the mixture, these properties can be modified and in particular, in the colored form of the second state, hypsochromic or bathochromic effects that can go as far as 80 nm can be observed.

Of course, other photochromic compounds can be used. In general these are chromenes with structural formulas of the following type:

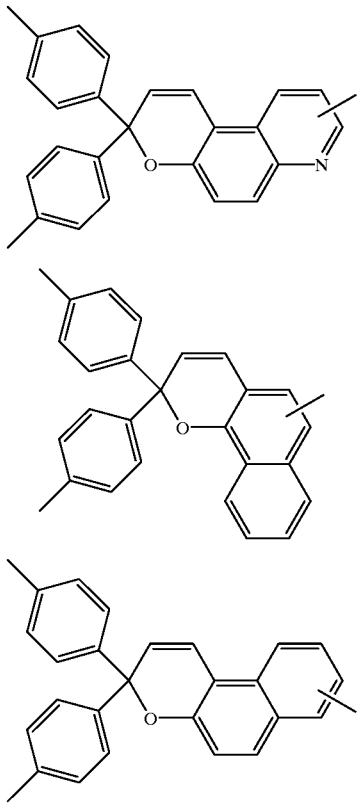

The reagent or reagents are intended to fix the second colored state and the colored state solely of the photochromic compound or compounds present in the mixture and solely this second colored state. In one example, these are salts of divalent metals, such as $MN^{2+}$, $Ni^{2+}$, $Zn^{2+}$, $Ca^{2+}$, $Pb^{2+}$, $Cd^{2+}$, $Mg^{2+}$, $Co^{2+}$, and $Cu^{2+}$, generally associated with an inorganic counter-ion of the $NO_3^-$, $Cl^-$, $Br^-$, $ClO_4^-$ type but also with an organic counter-ion such as the 1-hydroxy-2-naphthoate, 2-hydroxybenzoate, or 2-hydroxycarbazole-1-carboxylate ions, or organometallic complexes such as [Ni, acetylacetone, N, N, N', N'-tetramethylethylenediamine]$ClO_4$, [Ni.acetylacetone.N, N, N', N'-tetramethylethylenediamine]$BPh_4$, [Ni.benzoylacetone.N, N, N', N'-tetramethylethylenediamine]$ClO_4$.

However, the mixture will advantageously contain other compounds.

These are in particular additives, for example solvents, for separating the spectra, the absorption bands of the photochromic compounds present in the mixture so that a laser radiation acts on a given photochromic compound and solely on this photochromic compound with no possibility of interference.

The other compounds are also different additives such as anti-UV stabilizers designed to protect the data medium from aging.

The mixture obtained, containing photochromic compounds, is then according to the invention spread on a manufacturing base of the layer of the card body to be printed. This base, in one example, has a bottom and sides forming a frame. This cavity can contain one or more polymerized or prepolymerized layers or sublayers of the card body and possibly a micromodule inserted into these layers or sublayers.

The mixture spread on the manufacturing base of the layer to be printed is then irradiated with a laser electromagnetic radiation whose wavelength is in the UV range and preferably in the range extending from 200 to 400 nm, corresponding to an absorption band of one photochromic compound, and one only, present in the mixture, so that this compound becomes transformed to the colored form of its second state. It will be noted that the power of the laser radiation can be modulated, particularly as a function of wavelength, so that for example the photochromic response is itself modulated so that the colors obtained are hued.

Thus, when the mixture has n different photochromic compounds where n is a whole number, it can be irradiated by n laser radiations, each laser radiation having a given wavelength which can bring about transformation of one and only one photochromic compound of the n compounds. In other words, the n photochromic compounds are sensitive respectively and solely to the n wavelengths of the laser radiation irradiating the base. In particular, in the case where the card body has three colorless photochromic compounds in their first state and, respectively, yellow or green, magenta red and cyan blue in their second state, radiations with three different wavelengths in the UV range will be used, in particular the aforementioned range of 200 to 400 nm, with a first radiation transforming the first compound in its green or yellow state, a second radiation transforming the second compound in its magenta red state, and a third radiation transforming the third compound in its cyan blue state. Printing is then polychromic.

Irradiation is effected by the laser radiations, sequentially or simultaneously. It is directed to specific points on the surface of the layer to be printed, according to the desired pattern. For this purpose, the irradiation is effected pointwise, by a laser beam of a given diameter, or through a filter. Since there is relative displacement of the laser radiation relative to the layer of the card body to be printed, various cases are possible: either the manufacturing base of the layer moves with respect to the laser radiations whose positions are fixed, or the laser radiations move with respect to the fixed base, or the manufacturing base and the laser radiations move at the same time. These movements are controlled and coordinated by a computer with appropriate software.

Irradiation takes place before or after a step in which the mixture that has been spread is prepolymerized or polymerized, or the solvent is evaporated in the case of thermoplastics. Thus, depending on the case, the mixture irradiated is spread in a more or less viscous liquid state or in a prepolymerized, i.e. partially polymerized, or a polymerized solid state.

In the case where the polymerization and/or solvent evaporation step has not taken place before irradiation, it takes place afterward. This polymerization may be supplemented by post-polymerization or post-crosslinking which leads to production of crosslinked, interpenetrated, or semi-interpenetrated networks from a combination of two types of successive reactions with different mechanisms.

Another step in the method of the invention is irreversibly fixing photochromic compounds in their second colored state so that the printed pattern is preserved and cannot in particular change with the sun. Fixing prevents a return to the initial transparent form. This fixing is effected for example by the fixing reagent.

In one example, a spirooxazine, spironaphthooxazine, is blocked in its second state by a $Zn_{1/2}CO_2ROH$ metal complex as follows:

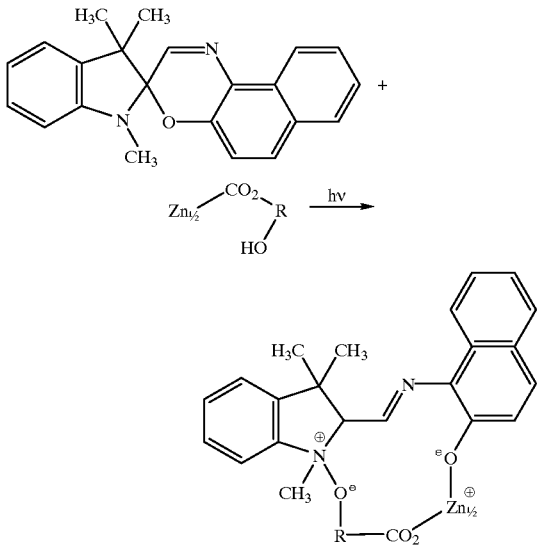

In another step of the method of the invention, the colorless form of the photochromic compounds that have not changed state is irreversibly fixed. This fixing can be done by a reagent. The colorless form can also be destroyed by raising the temperature or under UV with a wavelength less than approximately 200 nm. In the case of spirooxazines, for example, very short UV wavelengths, on the order of 100 nm, destroy the bonds. As before, the power of the UV can be modulated to fix the colorless form of the photochromic compounds.

Final fixing or blocking of the colored and colorless forms of the photochromic compounds can be effected or improved by polymerization or post-polymerization of the mixture, for example under the effect of short-wavelength UV radiation. This UV irradiation can also trigger blocking by the fixing reagents without triggering post-polymerization.

The aforesaid fixing and/or blocking steps can be performed at the same time. Blocking of the colored or colorless forms may also be simply mechanical, by evaporating the solvents.

Thus, the printed designs do not degrade over time under the effect of heat or light.

Post-polymerization may be local. It shifts the products and brings about a difference in refractive index, whereupon the product appears in polychromic relief.

Finally, the printed card can be dried by evaporating the solvents to produce a finished product.

Because of the method of the invention, it is possible to print approximately 20,000 visible layers or card surfaces directly and positively per hour, and these remain intact after printing. Also, definition of the printed designs is theoretically molecular. In practice, it is limited, in cases where irradiation is effected through a filter, to the screen dimensions of this filter and, where irradiation is done pointwise, to the size of the beam at the surface of the irradiated layer.

What is claimed is:

1. Method for printing a visible thermoplastic or thermosetting polymerized layer of a portable data medium, characterized by comprising the following steps:

mixing a thermoplastic or thermosetting polymerizable binder, and at least one photochromic compound sensitive to a laser radiation of a given wavelength in order to pass from a in order to form a mixture;

irradiating the mixture by laser radiation of a given wavelength;

fixing the second colored state; and polymerizing the mixture in order to form the polymerized layer of the data medium body.

2. Method according to claim 1, characterized in that the mixing step comprises mixing a reagent designed to fix the second colored state of the photochromic compound, with the fixing of the second colored state thus being induced by the reagent.

3. Method according to claim 1, characterized in that the first state of the photochromic compound is colorless.

4. Method according to claim 1, characterized in that the mixing step is done with n different photochromic compounds where n is a whole number and in that the irradiation step is carried out by laser irradiation with n different wavelengths, each wavelength being designed to cause one and only one photochromic compound to pass from a first state to a second colored state.

5. Method according to claim 4, characterized in that n is equal to 3 and in that a first compound has a second green or yellow colored state, a second compound has a second magenta red colored state, and a third compound has a second cyan blue colored state.

6. Method according to claim 4, characterized in that irradiation of the n photochromic compounds by the n laser radiations occurs simultaneously.

7. Method according to claim 4, characterized in that the irradiation of the n photochromic compounds by the n laser radiations takes place sequentially.

8. Method according to claim 1, characterized in that the mixture also includes additives for separating the excitation bands of the photochromic compounds present in the mixture so that there is no interference.

9. Method according to claim 1, characterized in that the irradiation takes place in the ultraviolet range.

10. Method according to claim 1, characterized in that it also includes a post-polymerization step.

11. Method according to claim 1, characterized in that the portable data medium is a memory card.

12. Method according to claim 1, characterized in that the portable data medium is a smart card.

13. Portable data medium including a visible printed thermoplastic or thermosetting polymerized layer of a data medium body, characterized in that said polymerized layer has:

a thermoplastic or thermosetting polymerized binder; and at least one photochromic compound fixed in a second colored state obtained from a first state by irradiation by a laser irradiation of given wavelength.

14. Portable data medium according to claim 13, characterized by comprising a smart card.

15. Portable data medium according to claim 13, characterized by comprising a memory card.

* * * * *

UNITED STATES PATENT AND TRADEMARK OFFICE

CERTIFICATE OF CORRECTION

PATENT NO. : 6,107,010
DATED : August 22, 2000
INVENTOR(S) : Isabelle Corniglion and Armand Gellis et al.

It is certified that error appears in the above-identified patent and that said Letters Patent is hereby corrected as shown below:

Column 8,
Lines 6 and 7, after "wavelength" add -- in order to pass from a first state to a second colored state, in order to form a mixture;

- irradiating the mixture by laser irradiation of a given wavelength --

Signed and Sealed this

Sixteenth Day of April, 2002

*Attest:*

*Attesting Officer*

JAMES E. ROGAN
*Director of the United States Patent and Trademark Office*